US011420804B2

(12) United States Patent
Lindsay et al.

(10) Patent No.: US 11,420,804 B2
(45) Date of Patent: Aug. 23, 2022

(54) DETACHABLY SECURABLE CONTAINER ASSEMBLY FOR A UNIT LOAD DEVICE

(71) Applicant: David Allen Lindsay, Kingston, NY (US)

(72) Inventors: David Allen Lindsay, Kingston, NY (US); Aaron Dwight Miller, Brooklyn, NY (US)

(73) Assignee: David Allen Lindsay, Kingston, NY (US)

( * ) Notice: Subject to any disclaimer, the term of this patent is extended or adjusted under 35 U.S.C. 154(b) by 333 days.

(21) Appl. No.: 16/587,436

(22) Filed: Sep. 30, 2019

(65) Prior Publication Data

US 2021/0094748 A1 Apr. 1, 2021

(51) Int. Cl.

| | |
|---|---|
| ***B65D 90/06*** | (2006.01) |
| ***B65D 81/05*** | (2006.01) |
| ***B65D 85/30*** | (2006.01) |
| ***B65D 90/00*** | (2006.01) |
| ***B65D 88/14*** | (2006.01) |

(52) U.S. Cl.

CPC ..... *B65D 81/052* (2013.01); *B65D 85/30* (2013.01); *B65D 88/14* (2013.01); *B65D 90/008* (2013.01); *B65D 90/06* (2013.01)

(58) Field of Classification Search

CPC .... B65D 90/325; B65D 90/06; B65D 90/008; B65D 90/022; B65D 88/14; B65D 85/30; B65D 81/052

USPC ..... 220/88.1, 62.19, 1.6

See application file for complete search history.

(56) References Cited

U.S. PATENT DOCUMENTS

| | | | | |
|---|---|---|---|---|
| 6,019,237 A * | 2/2000 | Durham | ..... | B65D 88/14 109/49.5 |
| 6,047,588 A * | 4/2000 | Danilychev | ..... | B65D 88/14 206/524.8 |
| 6,824,338 B2 | 11/2004 | Looker et al. | | |
| 7,408,775 B2 | 8/2008 | Walz et al. | | |

(Continued)

FOREIGN PATENT DOCUMENTS

| | | |
|---|---|---|
| JP | 2001335031 | 12/2001 |
| WO | WO9855376 | 12/1998 |
| WO | WO2011/003413 | 1/2011 |

*Primary Examiner* — King M Chu

(74) *Attorney, Agent, or Firm* — Simpson & Simpson, PLLC; S. Peter Konzel

(57) ABSTRACT

A container assembly configured for loading into/onto a Unit Load Device (ULD) generally includes first and second containers. Rearward sides of the first and second containers include a securing catchment assembly for mating and securing the first and second containers. Frontward sides of the first and second containers each include a plurality of female/male door securing assemblies that complementarily mate with male/female door securing assemblies of a door assembly. When the first and second containers are mated, the container assembly defines an outer perimeter that is smaller than an inner perimeter of the ULD. The outer perimeter of the container assembly has a shape generally conforming with the shape of the inner perimeter of the ULD. One or more shock absorption assemblies/airbag assemblies configured to reduce vibration and movement of the container assembly are disposable between one or more walls of the ULD and the first and second containers/container assembly.

19 Claims, 10 Drawing Sheets

(56) References Cited

U.S. PATENT DOCUMENTS

| | | | | |
|---|---|---|---|---|
| 8,261,924 | B2 | 9/2012 | Karpisek | |
| 8,469,310 | B2 | 6/2013 | Glaser et al. | |
| 9,004,307 | B2 | 4/2015 | Bradford et al. | |
| 9,019,719 | B2 | 4/2015 | Tomasi et al. | |
| 9,233,790 | B2 | 1/2016 | Bradford et al. | |
| 9,533,763 | B1 | 1/2017 | Kelly | |
| 9,637,306 | B2 | 5/2017 | Steinert et al. | |
| 9,676,548 | B2 | 6/2017 | Bradford et al. | |
| 9,783,341 | B1 | 10/2017 | Wilson et al. | |
| 9,896,256 | B2 | 2/2018 | Pansegrouw | |
| 9,969,316 | B2 | 5/2018 | Pansegrouw | |
| 10,138,018 | B2 | 11/2018 | Lee et al. | |
| 10,232,928 | B2 | 3/2019 | Hente et al. | |
| 2007/0257031 | A1* | 11/2007 | Looker | B65D 88/14 220/4.27 |
| 2011/0127379 | A1 | 6/2011 | Jager et al. | |
| 2013/0161331 | A1* | 6/2013 | Pherson | B32B 27/065 220/560.01 |
| 2016/0167782 | A1* | 6/2016 | Roth | B64C 1/22 244/118.1 |
| 2019/0055056 | A1 | 2/2019 | Lee et al. | |

* cited by examiner

DETACHABLY SECURABLE CONTAINER ASSEMBLY FOR A UNIT LOAD DEVICE

FIELD

The instant disclosure relates to the field of cargo transport, and more particularly, to a container assembly configured for use with a Unit Load Device (ULD) that is detachably securable, and readily received, within or on a ULD.

BACKGROUND

Unit Load Devices (ULDs) are devices used primarily for purposes of transporting cargo to be shipped as air freight and are often used to consolidate air cargo in order to assist with the loading and unloading process to/from an airplane or other air transport vehicle. ULDs come in two primary forms: pallets, which usually require the use of an air cargo net that is wrapped around the cargo to secure the cargo loaded thereon, and containers which secure the cargo loaded therein and which have one or more walls that are complementary with the interior fuselage of an air transport vehicle. In either case, when cargo is to be air transported via a ULD, the cargo to be shipped can either be delivered to an airline for loading onto/into a ULD, or a shipper can load a ULD on their end and transport the loaded ULD to an airline for subsequent transport. Hence, a ULD may be transported in a number of ways, e.g., truck, rail, ship, helicopter, airplane, etc.

In the case of the transport of fine artworks such as paintings or sculptures that may be displayed at museums or galleries, when such works are to be transported, for example via air transport between major international cities, the artworks are typically first soft-packed using one or more of glassine, plastic, cardboard, or similar packing materials. The soft-packed artworks are then crated into, for example, wooden crates custom crafted to secure and contain the artworks therein, for example, using foam layers and the like. Thereafter, the crate is then ground transported, sometimes via a third party for delivery to an airline for air transport, where it is either packed onto a ULD pallet or into a ULD container. It is generally accepted in the art industry that the greatest risks in shipping artworks are at the points in the delivery chain wherein the artworks must be handled. These risks include, but are not limited to, the accidental dropping or toppling of the crates, excessive vibration and exposure to the elements at transfer points, and are most pronounced when the shipment is in the care of airline employees, who are not specially trained in the handling of art. As may be appreciated, in the case of expensive or priceless artworks, palletization, for example, is not optimal because it can increase such risks, but can be unavoidable as the loading of crates onto an airplane is usually made at the discretion of the air transporter and/or is often based on availability of space and/or weight distribution issues related to air cargo payloads.

While the art industry generally considers crating of fine artworks to be mandatory for air shipments as a matter of safety, crating of artworks can be disadvantageous from both environmental and economic standpoints. For example, in order to custom fabricate a wooden crate for a specific artwork, one or more trees must be cut down in order to make the custom crate. Additionally, as custom crates are typically fabricated according to the dimensions of a specific artwork, it is often not possible to reuse a custom crate for another artwork due to its bespoke nature. Also, the storage of previously used custom crates for possible later use may not be economically feasible. Additionally, wooden crates add considerable weight to the cargo to be transported, which can substantially increase the amount of fuel that is burned for transport, which not only increases shipping costs, but also increases carbon emissions. Also, as wooden crates may not be readily stored, reused, and/or are often destroyed after only a few uses due to damage they may suffer as a result of careless transport or due simply to lack of affordable storage space, their use can unnecessarily contribute to landfills.

While it would be possible to address to some of the above concerns, for example, with the fabrication of new ULDs or the modification of existing ULDs, it should be appreciated that each of the above requires certification or recertification of a ULD by one or more appropriate aviation authorities, which can be a significant undertaking in terms of time and expense.

What is needed then is a container assembly for shipping artworks via an industry standard ULD, which container assembly is more environmentally friendly in that it may be reused, is primarily constructed of long lasting and/or recyclable materials, is lighter in weight when compared with custom wooden crates, safely and effectively secures artworks therein so as to prevent damage to the artworks, and is readily detachably securable and easily loadable within an industry standard ULD. By providing a container assembly that can be used in association with readily available industry standard ULDs, the fabrication of custom wooden crates and/or the need for custom ULDs can be reduced, thereby reducing cost and waste.

SUMMARY

At the outset it should be understood that while the following disclosure, figures, and/or claims, etc. describe subject matter including one or more aspects described as either alone or in combination with one or more other aspects, the subject matter of the instant disclosure is not intended to be so limited. That is, the instant disclosure, figures, and claims are intended to encompass the various aspects described herein, either alone or in one or more combinations with one another. For example, while the instant disclosure may describe and illustrate a first aspect, a second aspect, and a third aspect in a manner such that the first aspect is only specifically described and illustrated relative to the second aspect, or the second aspect is only described and illustrated relative to the third aspect, the instant disclosure and illustrations are not intended to be so limiting and may encompass the first aspect alone, the second aspect alone, the third aspect alone, or one or more combinations of the first, second, and/or third aspects, e.g., the first aspect and the second aspect, the first aspect and the third aspect, the second and third aspect, or the first, second and third aspects.

According to aspects described and illustrated herein, there is generally provided a container assembly detachably securable within or on an industry standard Unit Load Device (ULD). It should be appreciated that there are several types of industry standard ULDs, and for purposes of brevity, the instant disclosure describes and illustrates a container assembly configured for use with an industry standard ULD commonly known as an LD3 container. An LD3 container is typically loaded into the lower deck of the fuselage of an aircraft and on one side thereof. An LD3 container typically includes an angled "cutaway" along one corner thereof that is intended to be oriented toward an outboard side of an aircraft such that the ULD container has a generally conforming fit with the fuselage of the aircraft. A standard LD3 can have either a rigid or non-rigid door, and in the case of a non-rigid door a curtain may be suspended from above the door with straps for securing the curtain to the ULD container. It should be understood that while the instant disclosure describes and illustrates a container assembly configured for use with an LD3 container, such is for exemplary purposes only and the instant disclosure is not intended to be specifically limited for use with an LD3 container. That is, a container assembly described and illustrated herein may be used in association with, for example, ULDs designed for an upper deck of cargo aircraft and having an angled "cutaway" on a top corner rather than a bottom corner, ULDs that span the width of an aircraft that have angled cutaways on both left and right corners thereof, or ULDs that do not include "cutaways" and/or ULD pallets or platforms, etc.

According to some aspects, there is provided a container assembly configured for transport via a Unit Load Device (ULD) that includes a first container having a plurality of walls defining a first section and a second section. In some aspects, the first section defines an internal volume smaller than an internal volume of the second section (e.g., a section B). In some aspects, the first section has a length and height that is smaller than a length and height of the second section (e.g., a section B), the internal volume of the first section and the internal volume of the second section are closed to one another, but it is contemplated that they could be open to one another. In some aspects, the container assembly can further include a second container having a length, width and height that is equal to a length, width and height of the second section of the first container and can also include a door assembly including a plurality of male/female door securing assemblies. In some aspects, the first container and the second container each include respective mating male/female securing catchment assemblies disposed proximate their respective rearward sides, which are configured to complementarily mate and secure rearward portions of the first container and the second container to one another. In some aspects, the frontward sides of the first container and the second container each include a plurality of female/male door securing assemblies configured to complementarily mate with the male/female door securing assemblies of the door assembly such that the door assembly is configured to be secured to the first container and the second container, as well as mate and secure frontward portions of the first container and the second container to one another.

In some aspects, the container assembly can include a base support member configured to receive the first and second containers thereon. The base support member defines a top surface area that is equal to a bottom surface area defined by a combination of a bottom side of the second container and a bottom side of the second section of the first container. In some aspects, the base support member includes a foam layer and a rigid layer, the rigid layer configured to receive the first and second containers on a top surface thereof. In some aspects the base support member includes a plurality of first grooves/ribs disposed in a first direction for assisting the loading of the first container onto/into a ULD and a plurality of second grooves/ribs disposed in a second direction for assisting with the loading of the second container onto/into a ULD. In some aspects the first direction is perpendicular to the second direction. In some aspects the, perpendicularly disposed grooves/ribs intersect one another.

In some aspects of the container assembly, the base support member, the first container, the second container, and the door assembly form an assembled state, for example, as shown in FIG. 2, the container assembly in the assembled state defines a volume and outer shape that is configured for generally conforming fit within an inner volume and shape of a ULD container. In some aspects, the container assembly is configured for reception upon a ULD pallet and/or the ULD pallet includes a raised support member configured for contact with a wall of the first container corresponding to the first section, such that the container assembly may be stored thereon when not in use, and/or used for purposes of providing stability when artworks are loaded into the container assembly.

In some aspects, one or more outer walls of the first container and one or more outer walls of the second container are configured to receive/contact one or more airbag assemblies including a fluid inflatable bladder. In some aspects, the one or more airbag assemblies further comprise one or more of a protective cover, a rigid member, and an elastic member. In some aspects, the one or more airbag assemblies include a protective cover arranged to be disposed between the fluid inflatable bladder and a wall of the ULD. In some aspects, the one or more airbag assemblies include a rigid member and the fluid inflatable bladder is disposed on a side of the rigid member. In some aspects, the one or more airbag assemblies comprise a pair of rigid members each arranged on opposite sides of the fluid inflatable bladder. In some aspects, the one or more airbag assemblies include a rigid member including a recess that receives the fluid inflatable bladder therein. In one or more aspects the protective cover and/or a rigid member include assemblies for securing the airbag assemblies to one or more of the walls of a ULD or one or more walls of a container. In some aspects, an airbag assembly generally conforms with the dimensions of one or more walls of a ULD container or one or more walls of the first and second containers, e.g., such that a single airbag assembly may be utilized relative to a single wall. In some aspects, a plurality of airbag assemblies may be secured to a single wall of a ULD or a single wall of the first and second containers.

In some aspects, one or more outer walls of the first container, one or more outer walls of the second container, the door assembly, and the base support member comprise a foam.

In some aspects, the first container has a front wall portion corresponding to the first section and a front wall portion corresponding to the second section, and the front wall portion corresponding to the first section is configured for contacting an airbag assembly such that the front wall portion corresponding to the second section becomes recessed relative to the front wall portion corresponding to the first section.

In some aspects, when the first container, the second container, and the door assembly are secured to one another via the rearward side catchment securing assembly and the door securing assemblies to form an assembled state, the front wall portion corresponding to the second section of the first container and the front wall of the second container are configured to receive the door assembly thereon.

In some aspects, the one or more airbag assemblies include a valve or valves disposed proximate the frontward sides of the first and second containers such that once the container assembly is loaded into or onto a ULD, the valves may be readily accessed for inflation purposes. In some aspects, the one or more airbag assemblies are configured to be disposed between an outer wall of the first and second containers and an inner wall of a ULD. In some aspects, the one or more of the airbag assemblies are configured to be disposed between a plurality of outer walls of the first and second containers and a plurality of the inner walls of a ULD.

In some aspects, the first section of the first container includes an outer wall configured to be disposed toward an internal fuselage wall of a transport vehicle, which outer wall configured to be disposed toward the internal fuselage wall of a transport vehicle includes a shock absorption material. In some aspects, the shock absorption material comprises one or more of an airbag assembly, foam, or combinations thereof. In some aspects, the shock absorption material is configured to be disposed between the first container and an inner wall of ULD.

In some aspects, a protective cover can be disposed upon one or more of the airbag assemblies and/or shock absorption material, and between the one or more of the airbag assemblies and/or shock absorption material and an inner wall of a ULD. In some aspects, the protective cover is formed from a fiber matrix. In some aspects, the fiber matrix is formed from a material such as ballistic nylon, or Kevlar® or Tyvek®, commercially available from the Dupont Corporation, or substantial equivalents thereof. In some aspects, the protective cover can be secured to the container assembly of a ULD via buttons or snaps, flexible or elastic-type straps along with appropriate fasteners, such as buttons or snaps, rings or hook members, or hook and loop fasteners such as Velcro®, commercially available from Velcro BVBA.

In some aspects, a third container may be provided which has a length, width and height that is equal to a length, width and height of one or more of the second section of the first container or the second container. In such aspects, the rearward sides of the third container include a respective male/female securing catchment assembly configured for complementarily mating with one of the first container or the second container.

In some aspects, a method of loading a container assembly into a unit load device is described. According to an aspect of the method, the container assembly includes a first container having a plurality of walls defining a first section and a second section. The first section defines an internal volume smaller than an internal volume of the second section, and the walls of the first section have a length and height that is smaller than a length and height of the walls of the second section. The internal volume of the first section and the internal volume of the second section can be closed, but it is contemplated that they could be open to one another. The container assembly includes a second container having a length, width and height that is equal to a length, width and height of the second section of the first container. The container assembly can include a door assembly including a plurality of male/female door securing assemblies. The rearward sides of the first container and the second container each include a respective male/female securing catchment assembly configured to complementarily mate and secure the first container to the second container along their respective rearward sides. The frontward sides of the first container and the second container each include a plurality of female/male door securing assemblies configured to complementarily mate with the male/female door securing assemblies of the door assembly such that the door assembly is configured to be secured to the first container and the second container. According to the method, the first container is loaded into the unit load device and then slid sideways to the outboard side, allowing sufficient space in the doorway for the second container to be loaded. After the first container is loaded into the unit load device, the second container is loaded into the unit load device such that the respective male/female securing catchment assemblies of the first and second containers securably mate with one another. After the second container is loaded and secured to the first container, the door assembly is secured to the first and second containers via the plurality of male/female door securing assemblies of the door assembly that complementarily mate with the female/male door securing assemblies of the first and second containers.

In some aspects of the method, one or more airbag assemblies and/or shock absorption materials are disposed between one or more outer walls of the first container and/or one or more outer walls of the second container, and one or more inner walls of the ULD.

In some aspects of the method, after loading the first container and/or the second container, the one or more airbag assemblies are inflated with a fluid such that the first container and/or the second container is secured within the ULD via the inflated one or more airbags such that free movement of the first container and/or the second containers is arrested.

In some aspects, the container assembly includes a base support member having a foam layer and a rigid layer configured to receive the first and second containers on a top surface thereof. In some aspects, the rigid layer of the base support member includes a plurality of first grooves/ribs oriented in a leftward/rightward direction and disposed on the top surface of the base support member toward a first lateral side of the base support member, and a plurality of second grooves/ribs oriented in a frontward/rearward direction and disposed on a top surface of the base support member toward a second lateral side of the base support member opposite the first lateral side.

In some aspects, a container assembly configured to be loaded into a Unit Load Device (ULD) includes a first container having a first sidewall having a length, width and a height, a second container having a second sidewall having a length, width and height equal to the length, width and height of the first sidewall of the first container, and a door assembly including a plurality of male/female door securing assemblies. In some aspects, the rearward sides of each of the first container and the second container each include a respective male/female securing catchment assembly configured to complementarily mate and secure the first container to the second container along their respective rearward sides, and the frontward sides of the first container and the second container each include a plurality of female/male door securing assemblies configured to complementarily mate with the male/female door securing assemblies of the door assembly such that the door assembly is configured to be secured to the first container and the second container. In some aspects, when the first container and the second container are mated to one another to form a mated container assembly, the mated container assembly defines an outer perimeter that generally conforms with an inner perimeter defined by inner walls of the ULD, the outer perimeter of the mated container assembly being smaller than the inner perimeter of the ULD.

These and other aspects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice the example aspects.

It should be appreciated that the terms "substantially' and "generally" are synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when stating that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Figure 1:
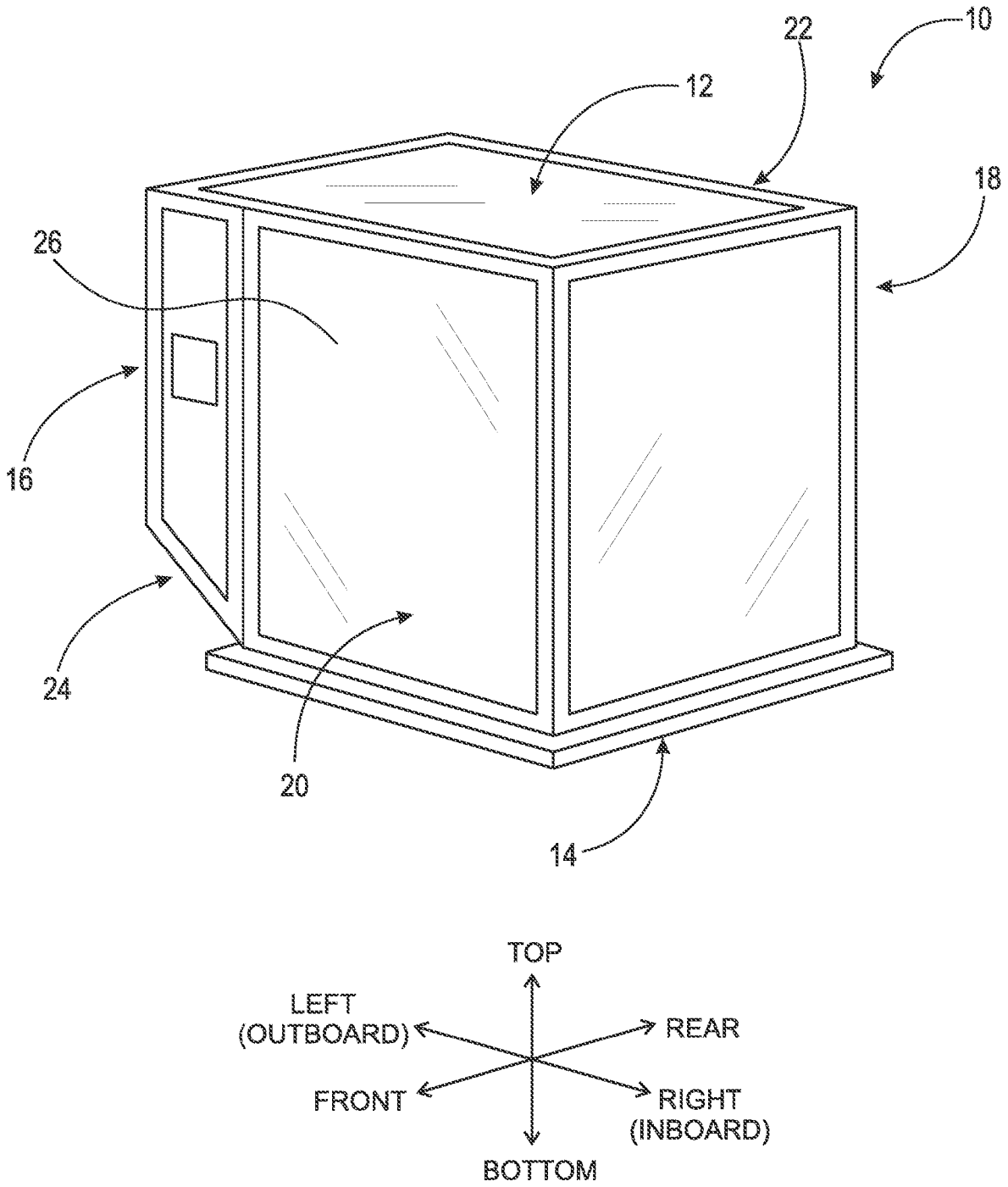
FIG. 1 is a perspective view of a standard LD3-type Unit Load Device (ULD) container.

Referring now to the figures, FIG. 1 is a perspective view of an industry standard Unit Load Device (ULD), and more specifically illustrates an LD3-type ULD container 10. As shown in the figure, LD3-type ULD container 10 generally includes upper side 12, lower side 14, leftward side 16, rightward side 18, frontward side 20, and rearward side 22. As may be appreciated, leftward side 16, which may also be described as an outboard side owing to the fact that it is configured to be oriented within an aircraft such that it is disposed proximate the fuselage of an aircraft includes angled side portion 24, includes angled side portion 24, which forms a so-called angled "cutaway" that allows the outboard oriented side 16 of the ULD 10 to generally conform with the shape an aircraft's fuselage. As may be appreciated from the figure, ULD 10 can be considered to include a portion corresponding to a 3-dimensional trapezoid and a portion corresponding to a cuboid. ULD 10 further comprises door 26, which may be formed of a rigid material, such as reinforced fiberglass, aluminum, etc., or may comprise a non-rigid material, such as canvas, plastic or combinations thereof, etc., forming a curtain. Where door 26 is in the form of a curtain or other non-rigid material, it may be suspended from above the door and utilize straps and/or other appropriate fasteners for securing the curtain to the ULD container. Finally, it should be understood that while the instant disclosure describes and illustrates a container assembly configured for use with an LD3 container, such is for exemplary purposes only and the instant disclosure is not intended to be specifically limited for use with an LD3 container. That is, a container assembly described and illustrated herein may be used in association with, for example, ULDs designed for an upper deck of cargo aircraft and having an angled "cutaway" on a top corner rather than a bottom corner, ULDs that span the width of an aircraft that have angled cutaways on both left and right corners thereof, or ULDs that do not include "cutaways" and/or ULD pallets or platforms, etc.

Figure 2:
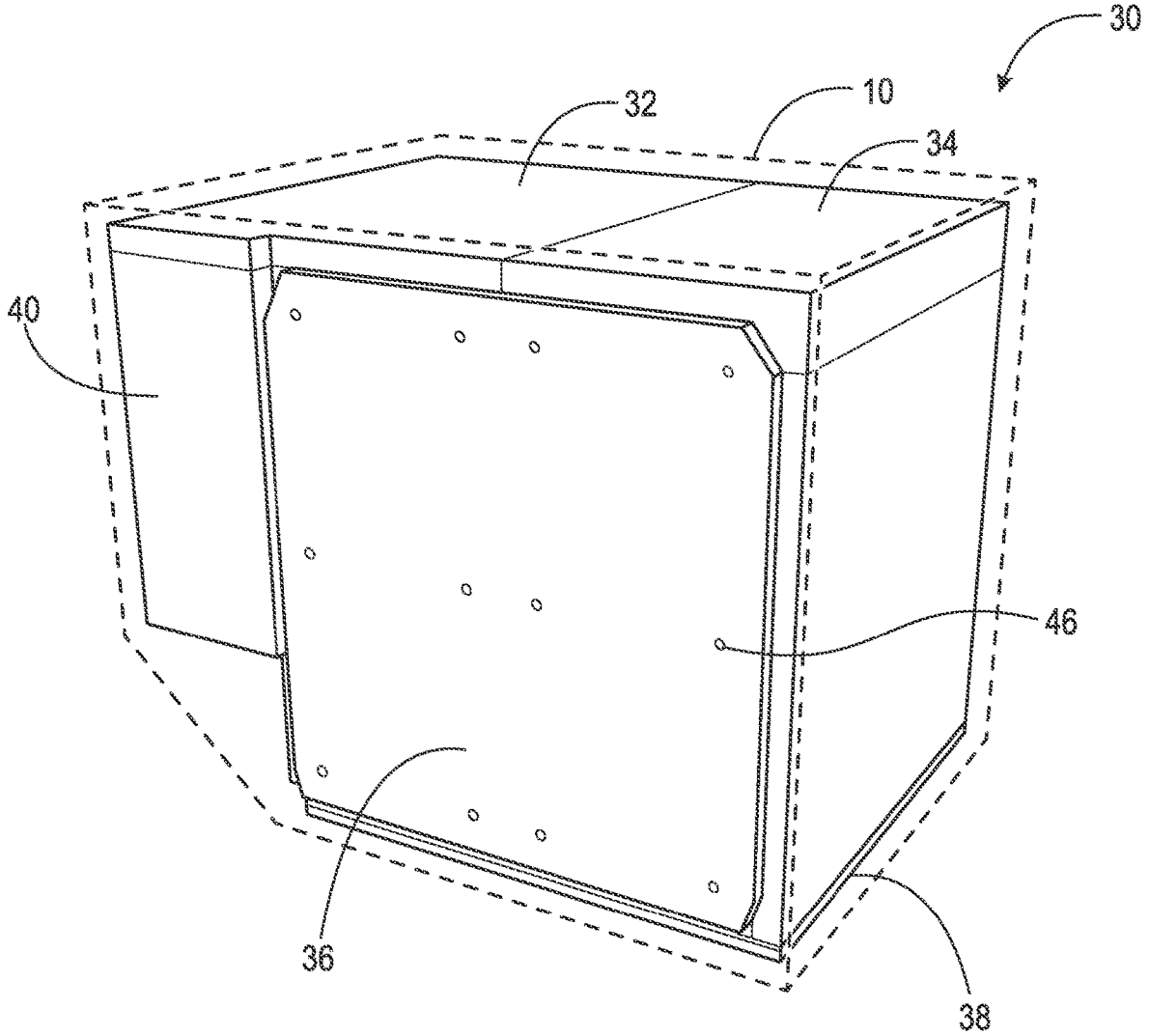
FIG. 2 is a perspective view of an assembled container assembly according to one or more aspects of the instant disclosure with dashed lines showing a perimeter defined by a standard ULD.
Figure 2:
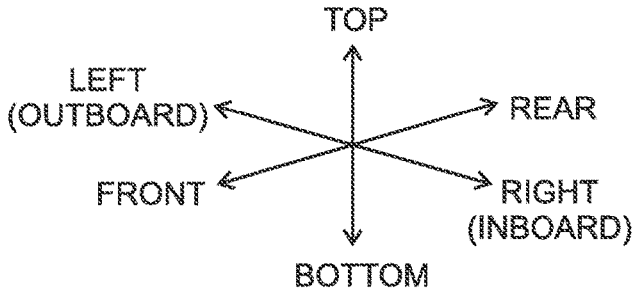
Figure 3A:
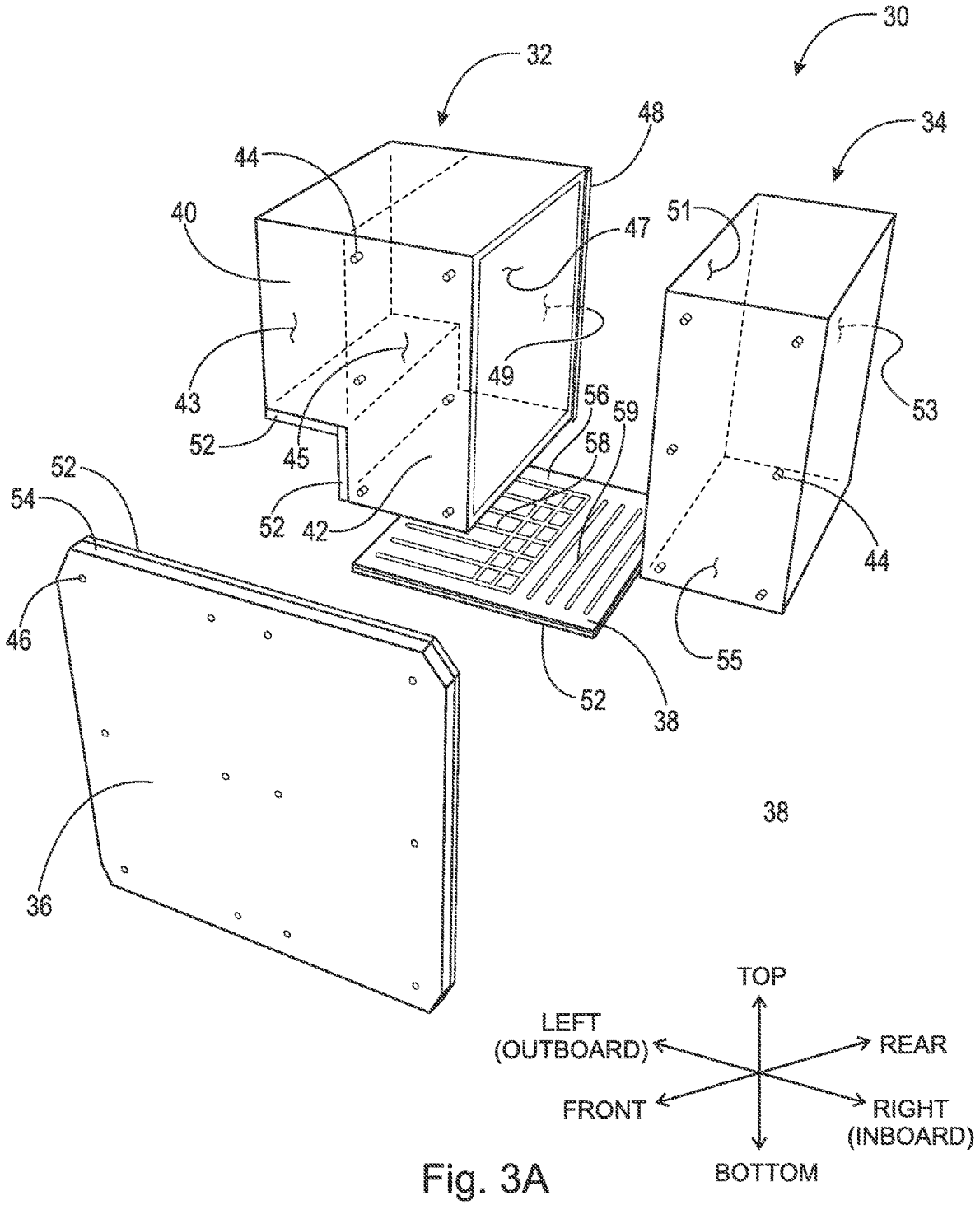
FIG. 3A is an exploded view of a container assembly according to one or more aspects of the instant disclosure.
Figure 3B:
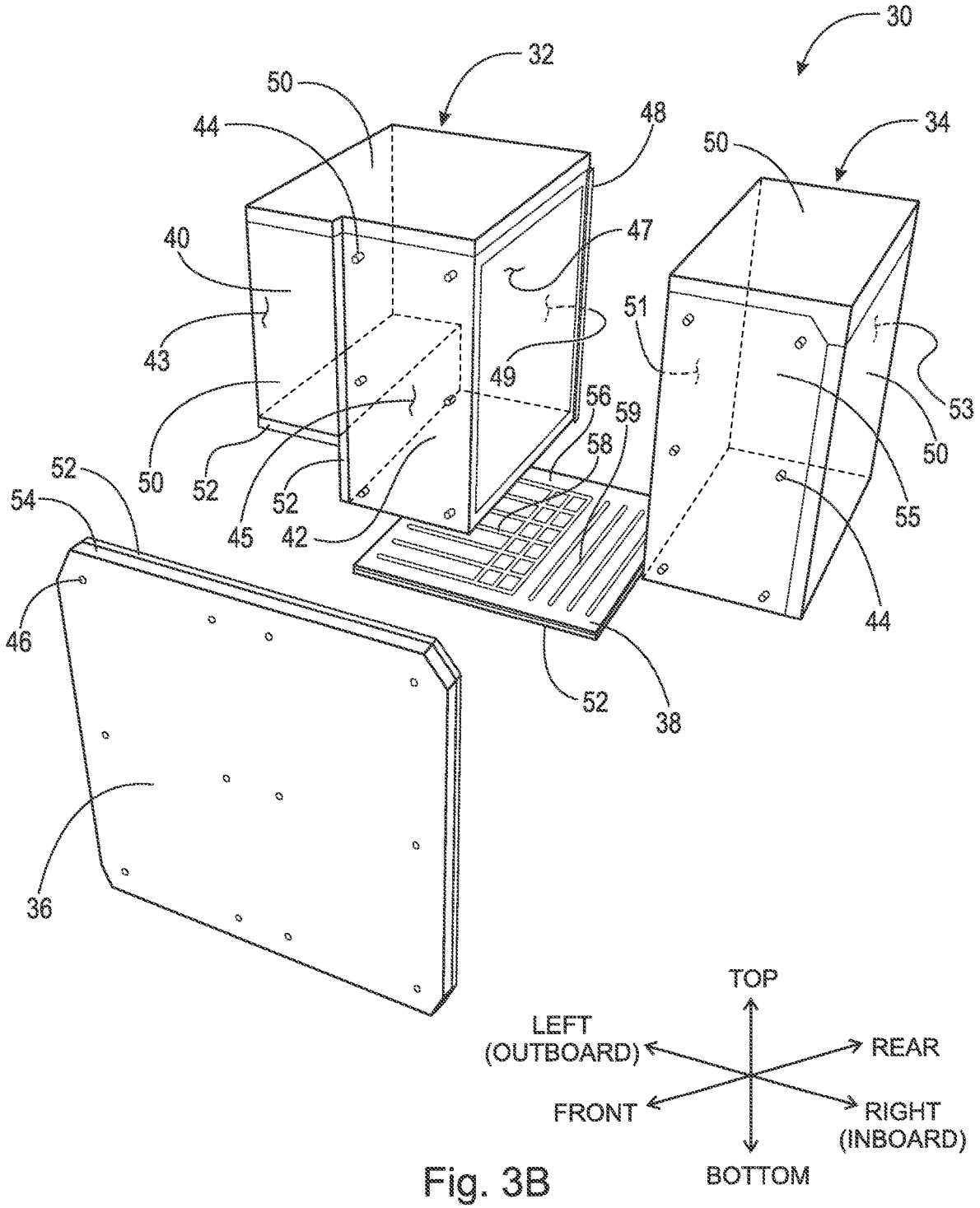
FIG. 3B is an exploded view of the container assembly of FIG. 3A further showing one or more of airbag assemblies and/or foam members disposed about one or more walls thereof.
Figure 4:
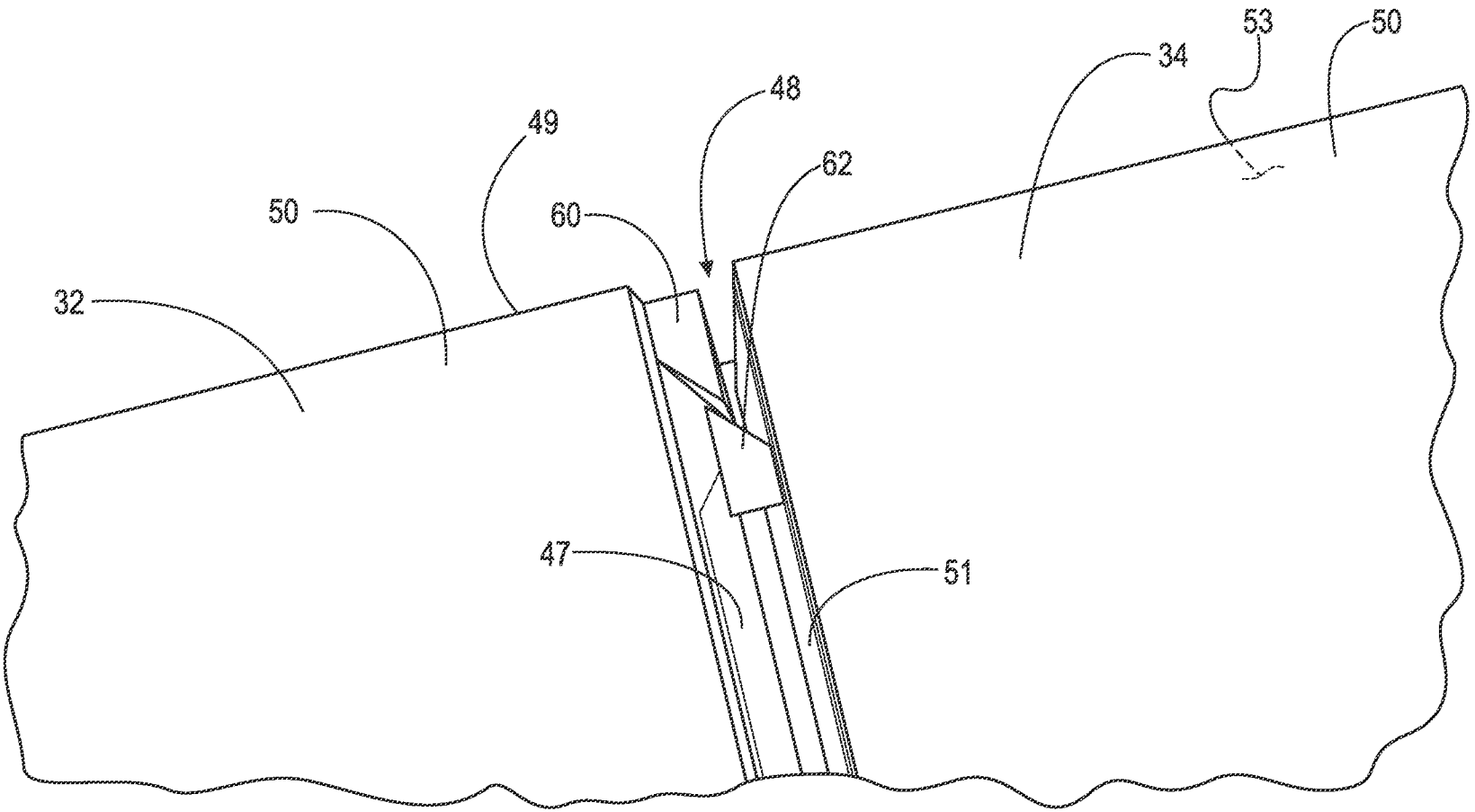
FIG. 4 is a close-up perspective view of mating securing catchment assemblies of each of the first and second containers disposed proximate each of their respective rearward sides.

Referring now to FIGS. 2-4, container assembly 30 according to one or more aspects described and illustrated herein is shown as generally including first container 32, second container 34, door assembly 36, and base support member 38. As shown in FIG. 2, when each of first container 32, second container 34, door assembly 36 and base support member 38 are loaded into ULD 10 (ULD 10 being as shown by the dashed lines of FIG. 2) and properly secured to one another to place them in an assembled state, the assembled container assembly 30 describes a perimeter that is smaller than the inner perimeter defined by the walls of ULD 10 such that the assembled container assembly 30 is receivable within ULD 10 and has a generally conforming fit with the shape and walls of the ULD 10. As also may be appreciated from FIG. 2, in an assembled state, container assembly 30 includes outer walls that may include one or more of later described airbag assemblies and/or shock absorption materials.

Referring now to FIGS. 3A-3B, which are exploded views of container assembly 30 without ULD 10. As previously described, container assembly 30 generally includes first container 32, second container 34, door assembly 36 and base support member 38.

First container 32 and second container each include a plurality of walls that may, for longevity and weight reduction purposes, be fabricated from substantially rigid materials such as one or more of aluminum, fiberglass reinforced plywood, composites, plastics, carbon fiber/resins, or like materials. In the case of fiberglass reinforced plywood, wall thicknesses of ¼ inches are contemplated.

First container 32 generally includes first section 40 and second section 42. First section 40 is generally configured for being received within a ULD on the side thereof corresponding to the shape/outboard side of an aircraft, and thus, and first section 40 has a size and shape that is smaller than that of second section 42. First section 40, thus, has an internal volume that is smaller than an internal volume of the second section 42. As may be appreciated from FIGS. 3A and 3B, first section 40 has a length (measured from the outboard/leftward side to the inboard/rightward side) and height (measured from bottom side to top side) that is smaller than a length and height of the second section 42.

Although it is not shown in the figures, the internal volume of the first section is closed to the internal volume of the second section 42 but can be open thereto. Alternatively, the internal volume of the first section 40 may be separated from the internal volume of the second section 42 by, for example, a partition such as curtain or a rigid member, such as a panel.

As also shown in FIG. 3B, when one or more later described airbag assemblies is disposed proximate the frontward side 43 of the first section 40, the first section 40 has a width (measured from the frontward to rearward sides) that is greater than the width of the second section 42 such that the frontward side 43 of the first section 40 extends frontward beyond the frontward side 45 of the second section 42, thereby forming a recess corresponding to the second section 42, which recess is capable of receiving a portion of the later described door assembly 36 therein. One or more of later described airbag assemblies 50 and/or foam members 52 may be disposed proximate rearward side 49 of the first container 40 for arresting or limiting movement of the container assembly when it is loaded into ULD 10. Frontward side 45 of second section 42 is shown as including one or more male/female mating fasteners 44, e.g. studs, for receiving mating female/male fasteners 46, e.g., boreholes, of door assembly 36 to detachably secure the door assembly 36 to the first container 32 (and to the later described second container 34). While FIGS. 3A and 3B illustrate mating fasteners 44/46 as comprising studs received within boreholes 46, other mating type fasteners, such as hook and loop type fasteners, are contemplated.

As also shown in FIG. 3B the top side of the first container 32 can be configured to receive thereon/contact one or more of later described airbag assemblies 50, foam members 52, such as Ethafoam® foam panels currently commercially available from Sealed Air, or combinations thereof, for arresting or limiting movement of the container assembly when it is loaded into ULD 10 and/or for providing vibration shock absorption qualities. The outboard side of the second section 42 of the first container are shown as including foam members 52, such as Ethafoam® foam panels currently commercially available from Sealed Air. The rearward side of the first container (and second container) are generally configured to receive/contact one or more of foam members 52 but may receive/contact one or more or airbag assemblies 50.

Finally, as shown in FIGS. 3-4, first container 40 is shown as also including inner oriented wall 47, which includes male/female portion 60 of wedge catchment assembly 48 disposed proximate rearward side 49 of the first container 40, which is male/female portion 60 is configured for receiving female/male catchment portion 62 of wedge catchment assembly 48, which is disposed on inner oriented wall 51 of second container 34 and proximate rearward side 53 thereof. It should be appreciated that while FIGS. 3 and 4 illustrate catchment portions 60/62 as substantially extending along the entire height of the first and second containers, the catchment portions 60/62 may be spaced at intervals along the height of the first and second containers so as to mate with one another. Additionally, as the first container is configured to be loaded into a ULD prior to loading the second container, the catchment portion 60 corresponding to the first container is disposed more rearward relative to catchment portion 62 of the second container, which is configured to be loaded into a ULD after the first container has been loaded. It should be appreciated that while catchment assembly 48 is described as comprising a pair of wedge shaped members, other shapes having faces that tend to draw the first and second containers together during loading, e.g., when the second container is pushed in a direction toward the rear of the ULD, but yet allow the first and second containers to be readily separated from one another during unloading operations by mere movement, are contemplated.

With regard to the second container, as shown in FIGS. 2-4, second container 34 is generally in the shape of a cuboid and has length, width and height that is equal to a length, width and height of the second section of the first container 32. Second container 34 is generally configured for being received within a ULD on the side thereof corresponding to the inboard side of an aircraft, and when loaded into ULD 10, is configured to align with the first container 32 along inner oriented walls 47 and 51. Although it is not shown in the figures, the internal volume of the second container can be equivalent to the internal volume of the second section of the first container.

As also shown in FIGS. 2-3B, the second container 34 has a width (as measured from frontward side 55 to rearward side 51) that is equal to the width of the second section 42 of the first container 32. Thus, when the first and second containers are positioned next to one another along their inner oriented walls 47 and 51, and an airbag assembly 50 is disposed between the frontward side of first section 43 and a wall of the ULD, a recess is formed that corresponds to the frontward side 45 of second section 34 of the first container 32 and the frontward side 55 of the second container 34, which recess is capable of receiving the later described door assembly 36 therein.

Frontward side 55 of second container 34 is shown as including one or more male/female mating fasteners 44, e.g. studs, for receiving mating female/male fasteners 46, e.g., boreholes, of door assembly 36 to detachably secure the door assembly 36 to the second container 34 (and to the first container 32). While FIGS. 3A-3B illustrate mating fasteners 44/46 as comprising studs received within boreholes 46, other mating type fasteners, such as hook and loop type fasteners, are contemplated.

As also shown in FIGS. 3A-3 B, the top side of the second container can be configured to include one or more later described airbag assemblies 50, foam members 52, such as Ethafoam® foam panels, or combinations thereof, for arresting or limiting movement of the container assembly when it is loaded into ULD 10 and/or dampening shock and vibration. The rearward side of the second container (and first container) is generally configured to receive/contact one or more of foam members 52 but may receive/contact one or more or airbag assemblies 50.

Finally, as shown in FIGS. 3A-4, second container 42 is shown as also including inner oriented wall 51, which includes male/female portion 62 of wedge catchment assembly 48 disposed proximate rearward side 53 of the second container 42, which male/female portion 62 is configured for receiving female/male catchment portion 60 of wedge catchment assembly 48, which is disposed on inner oriented wall 47 of first container 32 and proximate rearward side 49 thereof. It should be appreciated that while FIGS. 3A-4 illustrate catchment portions 60/62 as substantially extending along the entire height of the first and second containers, the catchment portions 60/62 may be spaced at intervals along the height of the first and second containers so as to align and mate with one another. Additionally, as the first container is configured to be loaded into a ULD prior to loading the second container, the catchment portion 60 corresponding to the first container is disposed more rearward relative to catchment portion 62 of the second container, which is configured to be loaded into a ULD after the first container has been loaded. It should be appreciated that while catchment assembly 48 is described as comprising a pair of wedge shaped members, other shapes having faces that tend to draw the first and second containers together during loading, e.g., when the second container is pushed in a direction toward the rear of the ULD, but yet allow the first and second containers to be readily separated from one another during unloading operations by mere movement thereof, are contemplated.

As previously discussed, first container 32 and second container 34 can be fabricated from a relatively lightweight yet durable material, such as aluminum, fiberglass reinforced plywood, composites, plastics, carbon fiber/resins, or like materials so as to sustain long term use. Generally, the first container 32 and second container 34 can be viewed as being "streamlined" when compared with custom wooden crates for packing art. That is, as a result of the use of shock and vibration dampening materials on and/or proximate the exterior of the containers, and the protective structure of the ULD container itself, the walls and faces of the first and second containers can be made thinner, which allow them to accept more works, and/or they may not require feet or skid members, bumpers, or other reinforcing elements common in wooden crates. Hence, they are typically lighter when compared with wooden crates. As also previously discussed, due to their being fabricated to generally conform with the dimensions and shape of a standard ULD, the first section 40 of the first container 32 can fit into the outboard section of a ULD above the "cutaway" angled side 24, while the second section 42 and the second container 34 can span the usable length, width and height of the main section of a ULD container.

Additionally, foam members 52 described herein can be covered in a semi-durable material, such as Tyvek®, commercially available from the Dupont Corporation, or substantial equivalents thereof, and adhered to one or more surfaces of the first and second containers, the door assembly, and/or the base support member as a semi-permanent feature such that they maintain their placement thereon, e.g., by appropriate adhesives or hook and loop type fasteners. According to some aspects, foam members 52 can cover one of each surface of a pair of opposing surfaces of the container assembly (where those surfaces are defined as (height×width), (height×length) and (width×length)), and an opposite surface may secure a later described airbag assembly 50, which can provide a desired adjustable tension between the container assembly 30 and walls of a ULD. Foam members 52 can secure each container in place along at least one dimension by virtue of the pressure of the pressure applied by the foam members to the ULD and also provide thermally insulative properties. Foam members 52 described herein can also be readily detachably securable to one or more surfaces of the first and second containers, the door assembly, and/or the base support member.

Turning now to the door assembly 36, as shown in FIGS. 2-3B, door assembly 36 is generally provided for securing the first container to the second container along frontward sides thereof when the first and second containers are loaded into ULD 10. To this end, door assembly 36 has a length, width and height that generally corresponds with the length, width and height of the frontward side 45 of the second section 42 of the first container 32 and the frontward side 55 of the second container 34 when the first container 32 and second container 34 are positioned next to and/or secured to one another along inner oriented walls 47 and 51. In other words, as shown in FIG. 2, door assembly 36 is appropriately dimensioned such that when it is secured to the first and second containers, its frontward oriented face is generally flush with the frontward side 43 of the first section 40 of the first container 32 including an airbag assembly 50.

As shown in FIG. 2 door assembly can be fabricated to include a rigid member 54 and a foam member 52. Rigid member 54 can be fabricated from substantially rigid materials such as one or more of aluminum, fiberglass reinforced plywood, composites, carbon fiber/resins, or like materials. Foam member 52 can comprise a rigid foam, such as Ethafoam® foam panels currently commercially available from Sealed Air. In some aspects, when door assembly 36 is secured to the first and second containers, the rigid member 54 is oriented such that it is disposed toward the outward side of the container assembly such that the risk of damage to the first and second containers may be reduced. One reason for this is that, as shown in FIG. 1, the doors 26 of some ULDs 10 comprise no more than mere fabric curtains, such that damage to cargo within the ULD may occur as a result of other improperly secured cargo crashing through a fabric door. Hence, by disposing the rigid member 54 toward door 26 of a ULD 10, risk of damage to the container assembly 30, and its contents, may be reduced.

As shown in FIGS. 3A-3B, door assembly 36 includes a plurality of female/male fasteners 46, e.g., boreholes, configured to align and mate with male/female fasteners 44, e.g. studs, of first container 32 and second container 34. While FIGS. 3A-3B illustrate mating fasteners 44/46 as comprising studs received within boreholes, other mating type fasteners, such as hook and loop type fasteners, are contemplated.

With regard to base support member 38, as shown in FIGS. 2-3B base support member 38 is generally provided for providing a generally cushioned platform within a ULD 10 upon which the first container 32 and the second containers 34 may be received and rest upon during storage or transport. To this end, base support member 38 has a length, width, and height that is receivable within and upon the floor of a standard ULD, and has a length (as measured from the outboard side to the inboard side) and a width (as measured from the frontward side to the rearward side) that is generally equivalent to that of the bottom side of the second section 42 of the first container 32 and the bottom side of the second container 34 when they are positioned next to one another and/or secured to one another along their inner-oriented walls 47/51. As shown in FIGS. 3A-3B, base support member 38 can be fabricated to include a rigid member 56 and a foam member 52. Rigid member 56 can be fabricated from substantially rigid materials such as one or more of aluminum, fiberglass reinforced plywood, composites, carbon fiber/resins, or like materials. Foam member 52 can comprise a rigid foam, such as Ethafoam® foam panels currently commercially available from Sealed Air. Rigid member 56 comprises a top surface of the base support member 38 which can be oriented such that it faces upwardly to receive the bottom surfaces of the first and second containers. As shown in FIGS. 3A-3B, the top surface of the base support member 38 can be configured to include a plurality of first grooves/ribs 58 oriented in a leftward/rightward direction and disposed on the top surface of the base support member 38 toward a first lateral side (i.e., the outboard side) thereof, and a plurality of second grooves/ribs 59 oriented in a frontward/rearward direction and disposed on a top surface of the base support member 38 toward a second lateral side thereof (i.e., an inboard side), which is opposite the first lateral side. Grooves/ribs 58 and 59 may intersect/overlap one another and may be formed as a component of the base support member itself, e.g., formed or molded thereon, or may comprise additional separate and distinct components added to the top surface of the surface of the base member. As may be appreciated from FIGS. 3A-3B, the orientation of the plurality of first and second grooves/ribs 58/59 serve to assist with loading/unloading of the first container into a ULD, and the plurality of second grooves/ribs 59 assist with the loading/unloading of the second container into a ULD. In other words, for example, the orientation of the plurality of second grooves/ribs 59 assist with the loading the first container into the ULD by allowing the first container to be first readily slid upon the second grooves/ribs 59 and into the ULD. From there, the orientation of the plurality of first grooves/ribs 58 allow the first container to be readily slid into a loaded position proximate the outboard wall of a ULD. Thereafter, the second grooves/ribs 59 allow the second container to be readily slid into position and secured within the ULD next to the first container. It should be appreciated that the base support member 38 substantially covers the main floor section of a ULD but is not affixed to it and can serve two primary purposes. The first purpose is that it allows the first and second containers to be readily slid into/onto a ULD container with ease, and a second purpose is that it assists in distributing any shock or vibration encountered from below.

Turning now to FIGS. 5A-51, as previously discussed, one or more surface the first and second containers and/or walls of a ULD can be configured detachably secure one or more airbag assemblies 50.

Figure 5A:
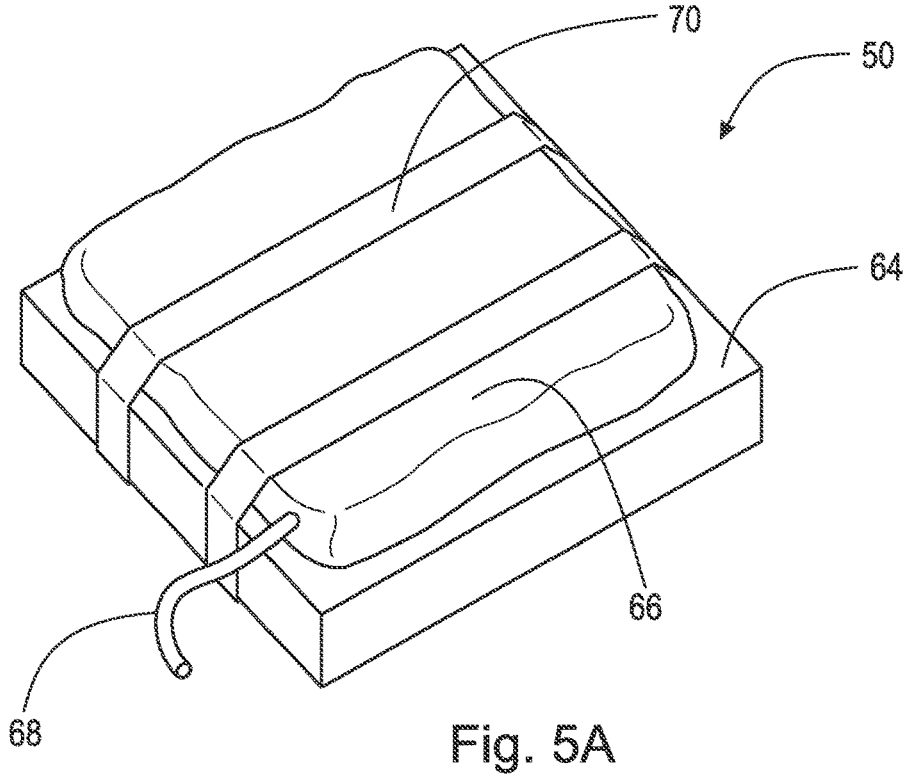
FIG. 5A is a perspective view of an airbag assembly according to one or more aspects of the instant disclosure illustrating a so-called "open-faced sandwich"-type arrangement.

As shown in FIG. 5A, in some aspects airbag assembly 50 can include a rigid member 64, a fluid inflatable bladder 66 including an inflation tube/valve assembly 68, and one or more elastic bands 70. Rigid member 64 can be a rigid panel of foam, for example, Ethafoam® currently commercially available from Sealed Air, wood, fiberglass, plastic, lightweight metals, composites or the like. Rigid member 64 can have a thickness that is smaller than that of foam member 52. Fluid inflatable bladder 66 is formed from a durable material and can be in the shape of a cuboid and can be secured to the rigid member 64, or detachably secured thereto as by, for example, hook and loop-type fasteners, or via elastic bands 70, which may be wrapped about a portion of the inflatable bladder 66 and a portion of rigid member 64. Fluid inflatable bladder 66 may also include a protective covering, such as a woven fabric of ballistic nylon, Kevlar® or Tyvek®. Fluid inflatable bladder can be inflated with air, other appropriate gas, or other appropriate fluid (e.g., a self expandable foam). The cuboid shape of the airbag assembly 50 can allow for pressure to be evenly applied across the one or more walls of the container assembly 30 and ULD 10. Airbag assembly 50 is configured to be disposed between one or more outer surfaces of the container assembly 30 and the walls of a ULD, and inflation tube/valve assembly 68 are provided for inflating/deflating the airbag assembly upon loading/unloading the container assembly to/from a ULD. Upon inflation, a snug fit of the container assembly 30 within the ULD can be obtained. Airbag assembly 50 can be configured to detachably secured to one or more walls of the container assembly 30 or the ULD 10, such as by hook and loop fasteners, for example, or inserted into a void that may be formed between a wall of the container assembly 30 and a wall of the ULD 10 and secured therein upon inflation. In either case, inflation tube/valve assembly 68 is positioned on the airbag assembly and is of sufficient length such that it may be readily accessed for inflation/deflation from, for example, the door 26 of ULD 10 when the components of the container assembly 30 are loaded/unloaded. In this regard, elastic bands 70 can further assist in loading/unloading by applying a force to cause the inflation bladder 66 to deflate when the tube/valve assembly 68 is opened. Deflation may also be provided via a vacuum. In some aspects, the airbag assembly of FIG. 5A can be secured to one or more surfaces of the container assembly 30 or ULD such that the inflatable bladder 66 is disposed between the one or more walls of the ULD 10 and the rigid member 62. That is, the inflatable bladder can be disposed toward the walls of the ULD and the rigid member 62 disposed toward the walls of the first and second containers prior to loading the first and second container, which is helpful in allowing the first and second containers to be more easily slide along the surfaces of the rigid members 62. While not limiting it as such, the airbag assemblies can be disposed upon one or more surfaces of the container assembly 30.

Figure 5B:
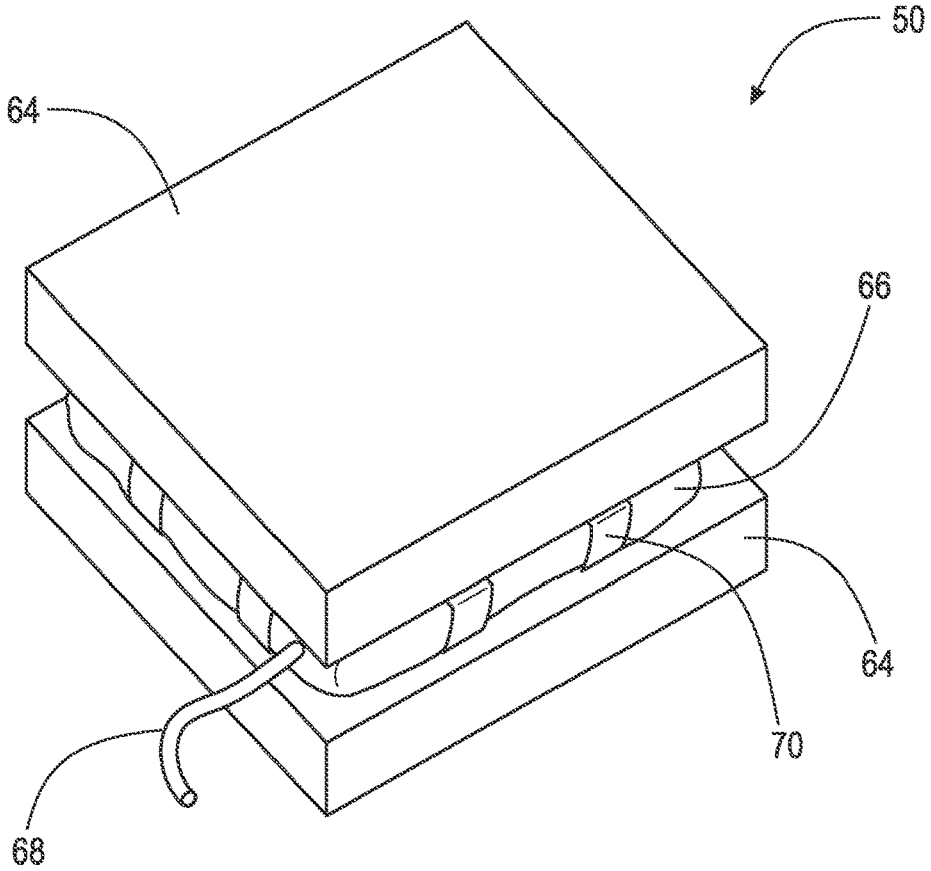
FIG. 5B is a perspective view of an airbag assembly according to one or more aspects of the instant disclosure illustrating a so-called "sandwich"-type arrangement.

As shown in FIG. 5B, in some aspects airbag assembly 50 includes features similar to that set forth in FIG. 5A, but can be adapted to further include a pair of rigid members 64 disposed on opposite sides of the fluid inflatable bladder 66 to thereby sandwich the inflatable bladder 66 therebetween, which can be helpful in avoiding damaging or puncturing the fluid inflatable bladder 66. In such configuration, it is seen that rather than being wrapped around each of the rigid members 64 and fluid inflatable bladder 66, elastic bands 70 may be secured between the rigid members 64 to thereby cause the members to be drawn toward one another, which can be helpful in loading and unloading operations. While not limiting it as such, the airbag assembly of FIG. 5B can be disposed on or more side surfaces of the container assembly 30.

Figure 5C:
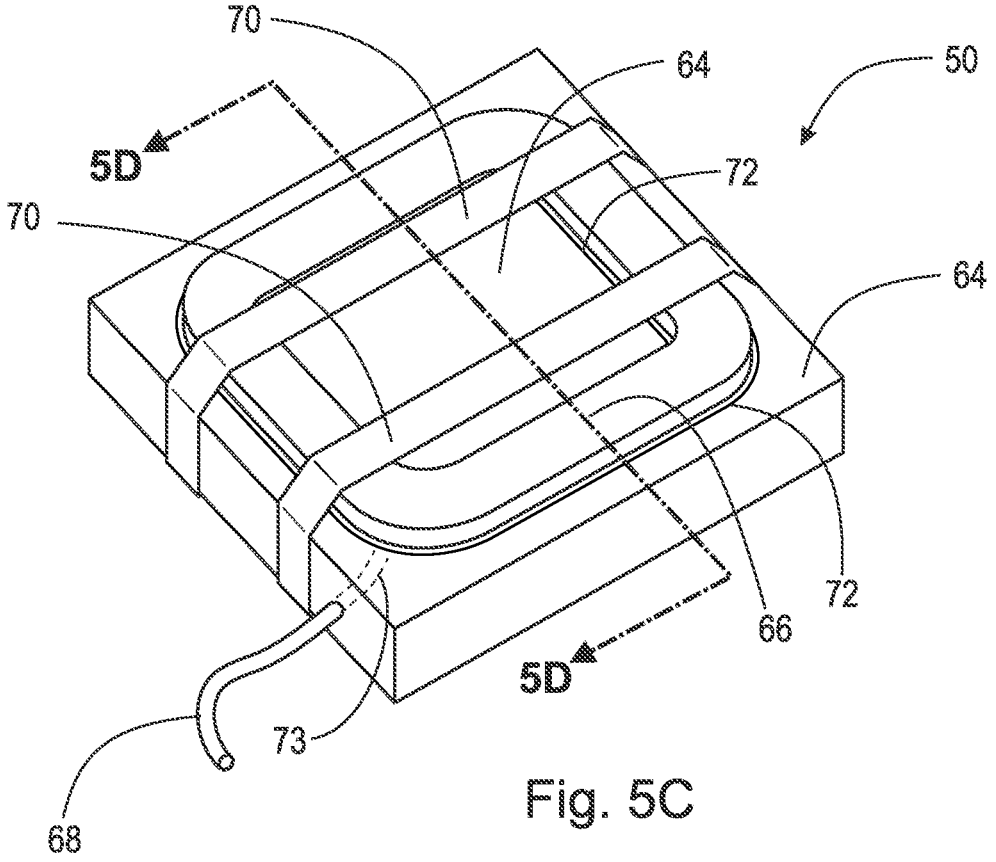
FIG. 5C is a perspective view of an airbag assemblies according to one or more aspects of the instant disclosure illustrating a so-called "donut"-type arrangement.
Figure 5D:
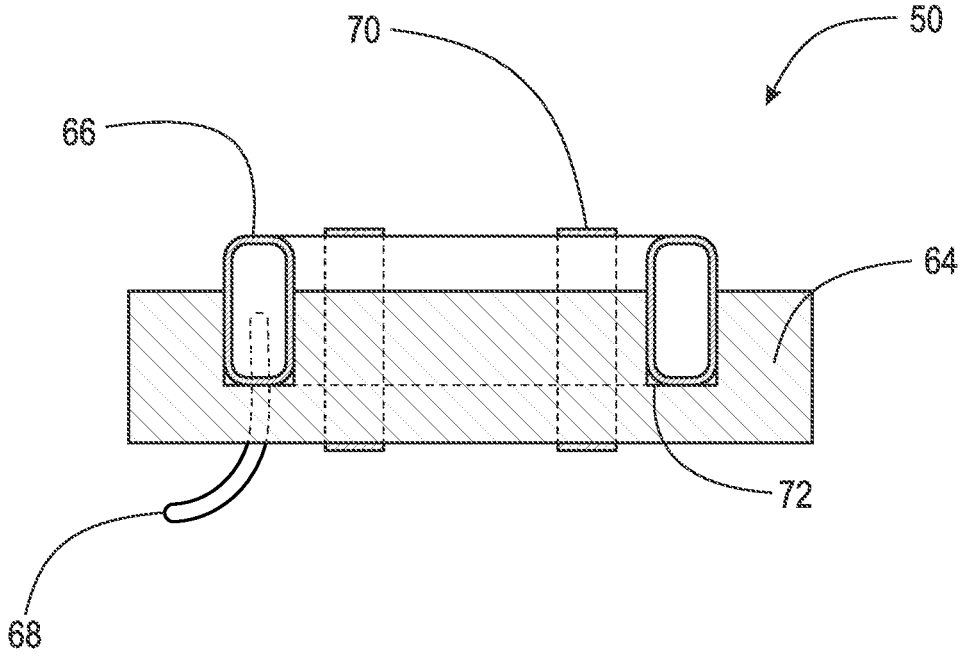
FIG. 5D is a cross-sectional view of the "donut"-type airbag assembly of FIG. 5C taken generally along line 5D-5D of FIG. 5C.

Referring now to FIGS. 5C and 5D, in some aspects, airbag assembly 50 includes features similar to those set forth in FIGS. 5A and 5B, but can be adapted such that it includes a rigid member 62 of sufficient thickness, e.g. a foam, such that a channel 72 may be formed therein, which channel 72 is capable of receiving an inflatable bladder 66 in the form of a circular tube therein. In some aspects, the airbag assembly of FIGS. 5C and 5D can include elastic bands 70 that wrap about portions of the rigid member 62 and the inflatable bladder. In some aspects including a channel 72, a borehole 73 can be provided within the rigid member 62 so as to pass the tube/valve assembly 68 therethrough. While not limiting it as such, the airbag assembly of FIGS. 5C and 5D can be disposed on the outboard side of the first container 40.

Figure 5E:
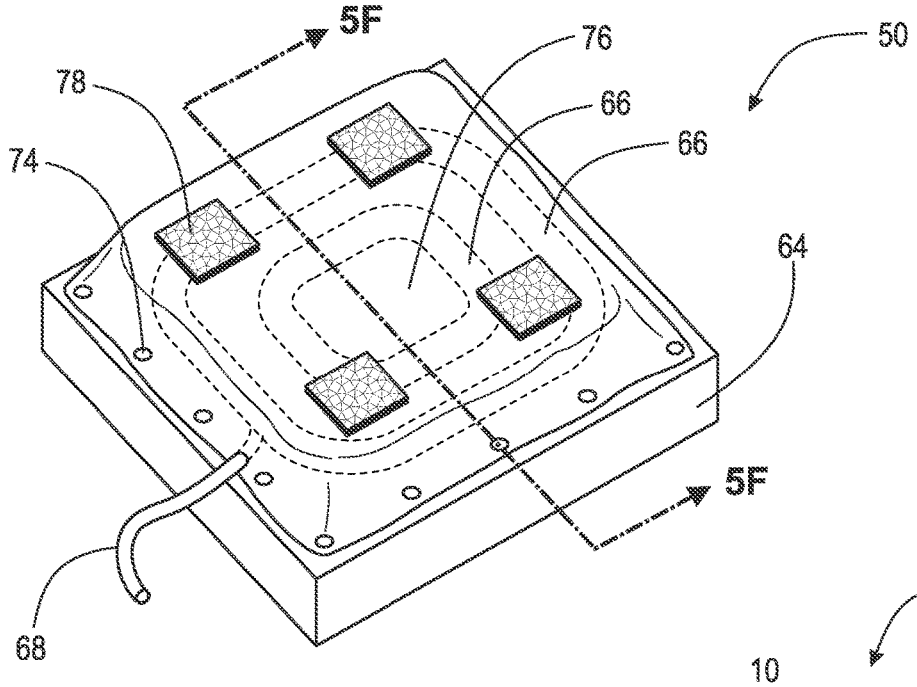
FIG. 5E is a perspective view of an airbag assembly according to one or more aspects of the instant disclosure including one or more tube inflatable bladders disposed beneath a protective cover.
Figure 5F:
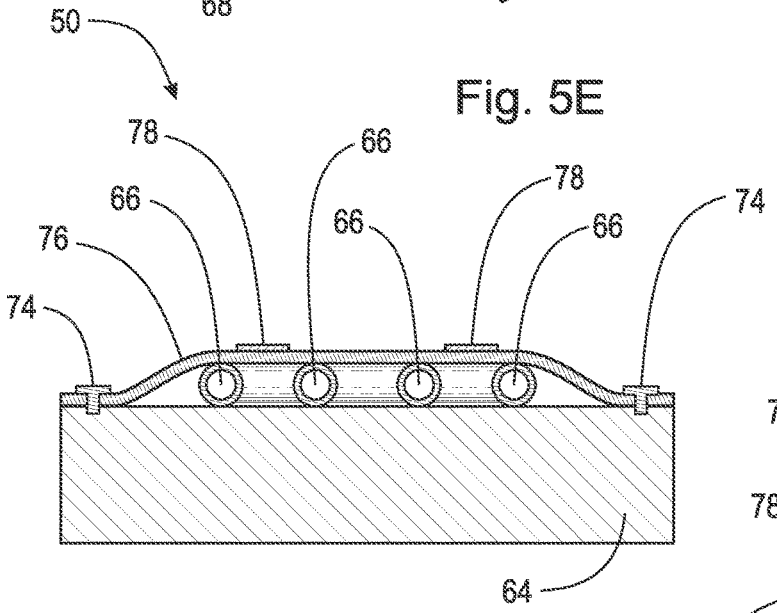
FIG. 5F is a cross-sectional view of the airbag assembly of FIG. 5E taken generally along line 5F-5F of FIG. 5E.
Figure 5G:
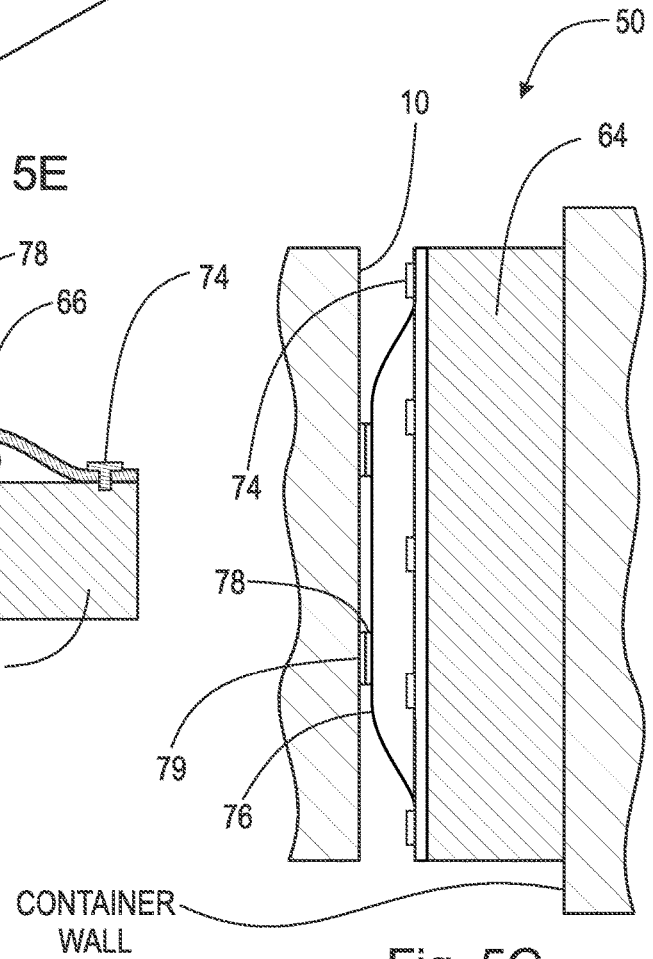
FIG. 5G is a view of the airbag assembly of FIG. 5E detachably secured to a wall of a ULD.

As shown in FIGS. 5E-5G, in some aspects, airbag assembly 50 can be configured to comprise rigid member 64, one or more inflatable bladders 66, which can include concentrically arranged inflatable tubes, and a protective cover 76. As shown in such figures, the protective cover 76 secures the one or more inflatable bladders 66 against the rigid member 64 by means of appropriate fasteners, e.g., snaps or buttons 74, that secure the protective cover to the rigid member 64. As also shown in FIGS. 5E-5G, protective cover 76 can include appropriate fasteners, e.g., hook and loop fasteners 78/79, for securing the airbag assembly to a wall of ULD 10. Accordingly, as may be inferred from FIG. 5G, prior to loading the first and second containers, when the airbag assemblies are first secured to the walls of ULD 10 such that the rigid members 62 are disposed toward the interior of the ULD (as by hook and loop fasteners 78/79 of the airbag assembly and ULD, the first and second containers may then be more easily loaded into the ULD 10.

Figure 5H:
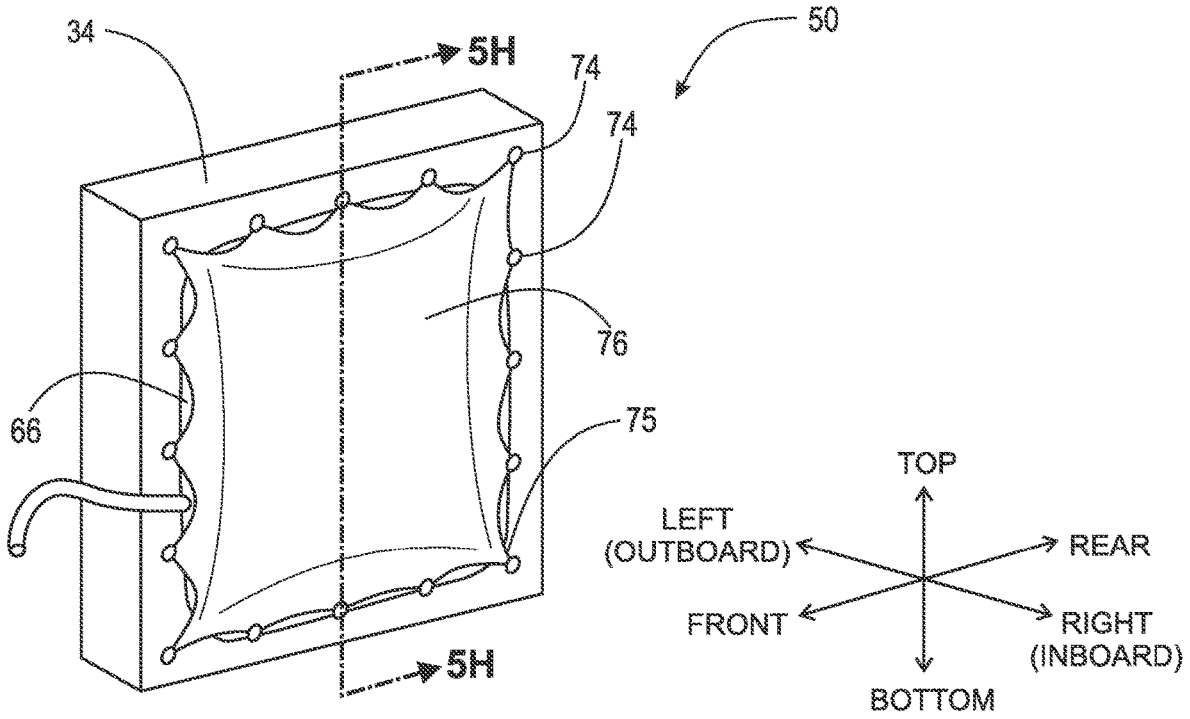
FIG. 5H is a partial perspective view of a container assembly including an airbag assembly and protective cover in accordance with one or more aspects of the instant disclosure.
Figure 5I:
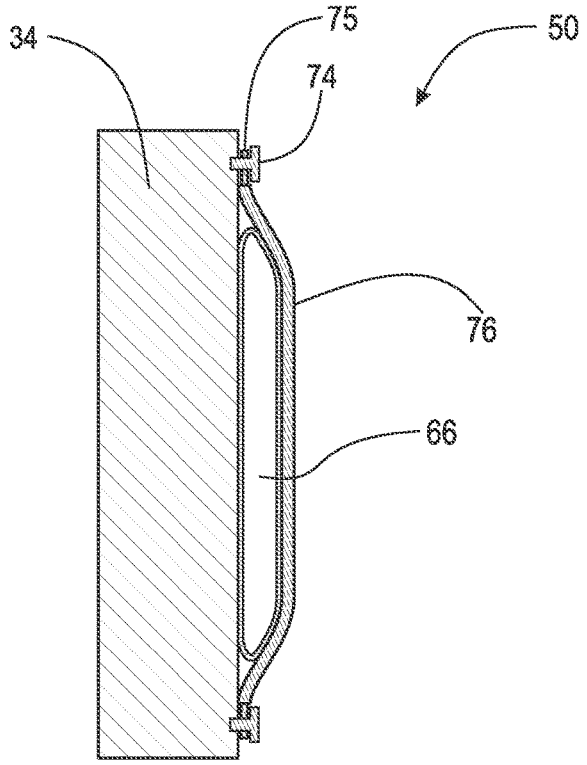
FIG. 5I is a cross-sectional view of the container assembly including the airbag assembly and protective cover of FIG. 5G taken generally along line 5H-5H of FIG. 5G.

Referring now to FIGS. 5H and 51, in some aspects airbag assembly 50 may be secured to one or more walls of the container assembly 30 and can detachably secure an inflatable bladder 66 via a protective cover 76. For example, as shown in FIG. 5E, protective cover 76 is shown including a plurality of flexible or elastic-type straps 75 that are secured to appropriate fasteners 74 of the second container 34. The straps 75 can include hook members attached thereto, for example, for mating catchment with D-rings, for example, of the second container assembly, which may self-recede into recesses in the walls of the one or more containers when not in use. The straps 75 and fasteners 74 may comprise hook and loop fasteners such as Velcro®, commercially available from Velcro BVBA. In place of straps and fasteners, snap assemblies and/or buttons may be utilized to secure protective cover 76 to the one or more containers. In some aspects, the protective cover 76 can be formed from a fiber matrix. In some aspects, the fiber matrix is formed from a material such as ballistic nylon, or Kevlar® or Tyvek®, commercially available from the Dupont Corporation, or substantial equivalents thereof. While not limiting it as such, the airbag assembly of FIGS. 5E and 5F can be disposed one or more surface of the container assembly 30 in addition to any of the other airbag assemblies 50 described herein. Additionally, one or more of the airbag assemblies 50 of FIGS. 5A-5F may be used alone or in combination with another on one or more surfaces of the container assembly 30.

In view of the foregoing, a method of loading container assembly 30 into ULD 10 can be accomplished by first loading the first container 32, as by sliding movement, into the ULD 10 such that it is disposed proximate an outboard side of the ULD 10. After the first container 32 has been loaded into the ULD, the second container 34 can be loaded into the ULD, as by sliding, such that the respective male/female securing catchment assemblies 60/62 of the first and second containers securably mate with one another. After the second container 34 is loaded and secured to the first container 32, the door assembly 36 is then secured to the first container 32 and the second container 34 via the plurality of male/female door securing assemblies 44/46 of the door assembly 36 that complementarily mate with the female/male door securing assemblies of the first and second containers. Thereafter, one or more airbag assemblies 50 that are disposed between one or more outer walls of the first container, one or more outer walls of the second container, and one or more inner walls of the ULD, or which are then disposed in voids between the outer walls of the container assembly 30 and the ULD 10 may be inflated with a fluid via the tube/valve assembly 68 to thereby snugly secure the container assembly 30 within the ULD.

Figure 6A:
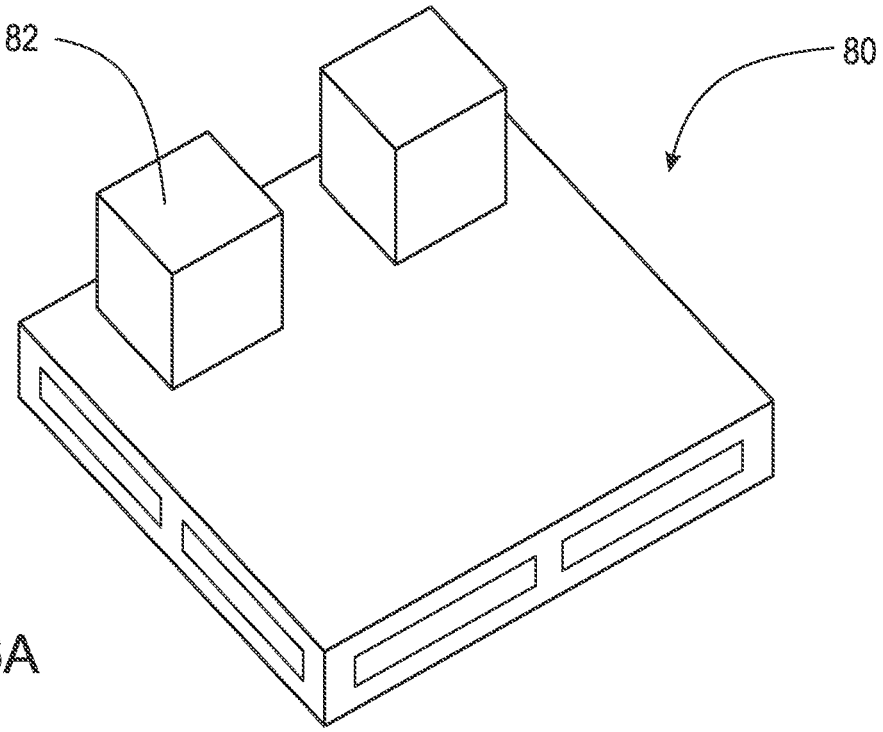
FIG. 6A-6B are perspective views of a ULD pallet or platform capable of receiving a container assembly according to aspects of the instant disclosure.
Figure 6B:
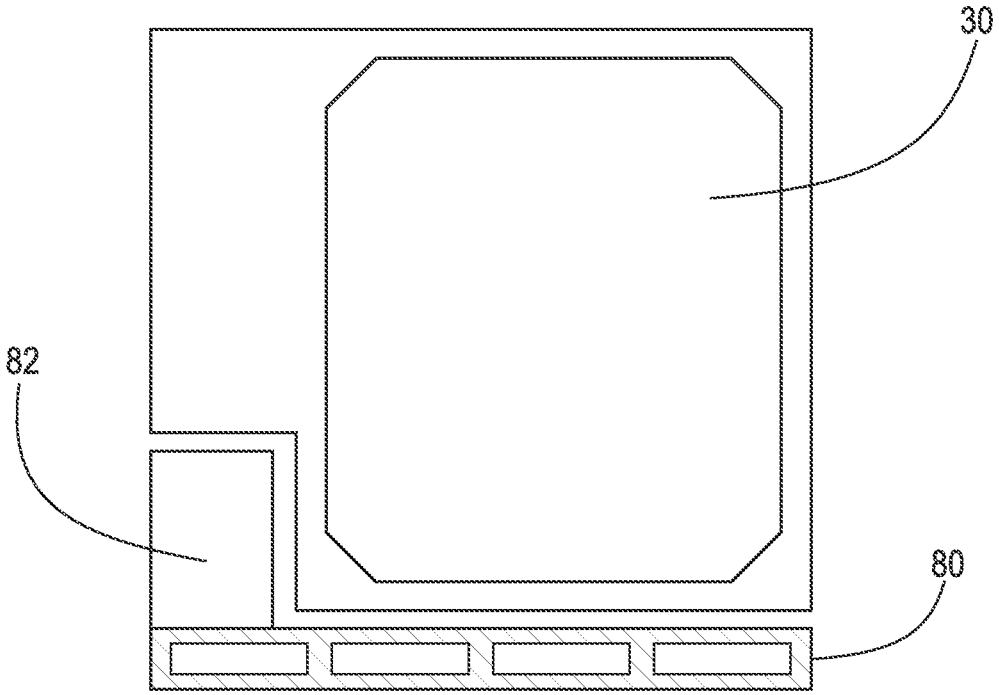

Finally, as shown in FIGS. 6A and 6B, the container assembly 30 according to one or more of its previously discussed aspects can be upon a custom ULD pallet or platform 80 for loading of contents, storage or transport. As shown in the figure, ULD pallet or platform 80 includes one or more supporting members 82 for receiving and supporting the bottom surface of the first container 32 corresponding to the first section 40 thereon. In a case where the platform is used for transport, one or more airbag or foam assemblies may be disposed between the supporting members 82 and the bottom surface of the first section and straps or a cargo net placed about the container assembly 30 to secure it thereon.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 ULD
12 Top Side
14 Bottom Side
16 Left/Outboard Side
18 Right/Inboard Side
20 Front Side
22 Rear side
24 Angled Side
26 Door
30 Container Assembly
32 First Container
34 Second Container
36 Door Assembly
38 Base Support Member

40 First Section
42 Second Section
43 Front Side of First Section
44 Fasteners (e.g., Studs)
45 Front Side of Second Section
46 Boreholes
47 Inner Oriented Wall of First Container
48 Catchment Assembly
49 Rear Side of First Container
50 Airbag Assembly
51 Inner Oriented Wall of Second Container
52 Foam Member
53 Rear Side of Second Container
54 Rigid Layer of Door
55 Frontward side of Second Container
56 Rigid Layer of Base Support Member
58 First Oriented Grooves/ribs
59 Second Oriented Grooves/ribs
60 Catchment Portion (First Container)
62 Catchment Portion (Second Container)
64 Rigid Member (Foam Sheet/Wood/Plastic) (Airbag Assembly)
66 Inflatable Bladder (Airbag Assembly)
68 Tube/Valve Assembly (Airbag Assembly)
70 Elastic Band (Airbag Assembly)
72 Channel
73 Borehole
74 Fasteners (e.g., Studs/Recessed D-rings/Hook and Loop/Snaps)
76 Protective Cover
78 Fastener (Hook and Loop) (Airbag)
79 Fastener (Hook and Loop) (ULD)
80 ULD Platform
82 Support Members

What is claimed is:

1. A container assembly configured for transport via a Unit Load Device (ULD), the container assembly comprising:

a first container;

a second container; and a door assembly including a plurality of male/female door securing assemblies;

wherein, the first container and the second container each include respective mating male/female securing catchment assemblies disposed proximate their respective rearward sides, the securing catchment assemblies configured to complementarily mate and secure rearward portions of the first container and the second container to one another; and, wherein, the frontward sides of the first container and the second container each include a plurality of female/male door securing assemblies configured to complementarily mate with the male/female door securing assemblies of the door assembly such that the door assembly is configured to be secured to the first container and the second container, and mate and secure frontward portions of the first container and the second container to one another, wherein one or more airbag assemblies each including one or more fluid inflatable bladders are disposable between one or more outer walls of each of the first and second containers and one or more walls of a ULD, the one or more fluid inflatable bladders being one or more of a round or square-shaped-type bladder, a tube, or a circular tube.

2. The container assembly of claim 1, further comprising a base support member configured to receive the first and second containers thereon, the base support member defining a top surface area that is equal to a bottom surface area defined by a combination of a bottom side of the second container and a bottom side of the second section of the first container.

3. The container assembly of claim 2, wherein when the first container and the second container are placed upon the base support member and secured to one another via the rearward side catchment securing assembly and the door securing assemblies to form an assembled state, the container assembly in the assembled state defines a volume and outer shape that is configured for generally conforming fit within an inner volume and shape of a ULD container.

4. The container assembly of claim 2, wherein one or more outer walls of the first container, one or more outer walls of the second container, the door assembly and the base support member comprise a foam.

5. The container assembly of claim 2, wherein the base support member comprises a foam layer and a rigid layer, the rigid layer configured to receive the first and second containers on a top surface thereof.

6. The container assembly of claim 5, wherein the rigid layer of the base support member includes:

a plurality of first grooves/ribs oriented in a leftward/rightward direction and disposed on the top surface of the base support member toward a first lateral side of the base support member the top surface; and, a plurality of second grooves/ribs oriented in a frontward/rearward direction and disposed on a top surface of the base support member toward a second lateral side of the base support member opposite the first lateral side.

7. The container assembly of claim 1, wherein the first container has a front wall portion corresponding to a first section and a front wall portion corresponding to a second section, and wherein when the first and second containers are secured to one another and an airbag assembly is disposed between the front wall portion corresponding to the first section and ULD, a recess corresponding to the front wall portion corresponding the second section and the front wall of the second container is formed.

8. The container assembly of claim 7, wherein the door assembly is receivable within the recess.

9. The container assembly of claim 1, wherein the one or more airbag assemblies include a valve or valves configured to be disposed proximate the frontward sides of the first and second containers.

10. The container assembly of claim 1, wherein the one or more airbag assemblies further comprise one or more of a protective cover, a rigid member, and a foam member.

11. The container assembly of claim 10, wherein the airbag assembly comprises one or more of a rigid member or a foam member and one or more of the fluid inflatable bladders are disposed on a side of the one or more rigid member or foam member.

12. The container assembly of claim 11, wherein the one or more airbag assemblies comprises a rigid member including a recess that receives the fluid inflatable bladder therein.

13. The container assembly of claim 10, wherein the one or more airbag assemblies include a protective cover and one or more of a rigid member and/or a foam member, wherein the one or more inflatable bladders are sandwiched between the one or more of the rigid member and/or the one or more of the foam member and the protective cover, wherein the protective cover is secured to the one or more of the rigid member and/or the one or more of the foam member, and wherein the one or more airbag assemblies are configured to be disposed within the ULD such that the protective cover is in contact with a wall of the ULD.

14. The container assembly of claim 10, wherein the one or more airbag assemblies comprise a pair of rigid members, or a pair of foam members, or a combination of a rigid member and a foam member, each arranged on opposite sides of the fluid inflatable bladder.

15. The container assembly of claim 1, wherein the one or more airbag assemblies comprise a protective cover arranged to be disposed between the one or more fluid inflatable bladders and a wall of the ULD.

16. The container assembly of claim 1, wherein the one or more airbag assemblies are detachably securable to one or more walls of the ULD.

17. The container assembly of claim 16, wherein the one or more airbag assemblies are detachably securable to the one or more walls of the ULD via hook and loop fasteners.

18. The container assembly of claim 1 wherein the inflatable bladders comprise a plurality of circular tubes concentrically arranged relative to one another.

19. The container assembly of claim 1, wherein the one or more airbag assemblies has a size and shape that generally conforms to a size and shape of one or more walls of the first and second containers.

* * * * *